United States Patent [19]

Sekiguchi et al.

[11] Patent Number: 4,906,120

[45] Date of Patent: Mar. 6, 1990

[54] POWDER DISPENSER

[75] Inventors: Tomozo Sekiguchi, Kawaguchi; Toshiyuki Sasaki, Edogawa, both of Japan

[73] Assignee: Pentel Kabushiki Kaisha, Tokyo, Japan

[21] Appl. No.: 228,776

[22] Filed: Aug. 4, 1988

Related U.S. Application Data

[62] Division of Ser. No. 929,809, Nov. 13, 1986, abandoned.

[30] Foreign Application Priority Data

| | | | |
|---|---|---|---|
| Nov. 15, 1985 | [JP] | Japan | 60-256379 |
| May 30, 1986 | [JP] | Japan | 61-124780 |
| Oct. 9, 1986 | [JP] | Japan | 61-240560 |
| Oct. 17, 1986 | [JP] | Japan | 61-246896 |
| Oct. 17, 1986 | [JP] | Japan | 61-246897 |

[51] Int. Cl.[4] ..... A45D 33/00; A45D 33/14

[52] U.S. Cl. ..... 401/268; 401/146; 401/149; 401/172; 401/175; 401/279; 401/288

[58] Field of Search ..... 401/143, 146, 149, 150, 401/175, 268, 270, 110, 111, 68, 75, 171, 172, 288, 279

[56] References Cited

U.S. PATENT DOCUMENTS

| | | | |
|---|---|---|---|
| 532,645 | 0/1895 | Cushing et al. | 401/149 |
| 870,257 | 11/1907 | Stevens | 401/149 |
| 1,489,414 | 4/1924 | D'Alessandro | 401/143 |
| 2,409,847 | 10/1946 | Gregg | 401/143 |
| 3,008,172 | 11/1961 | Thompson | 401/149 |
| 3,132,743 | 5/1964 | Wolff | 401/68 |
| 3,506,164 | 4/1970 | Weichselbaum et al. | 401/111 XR |

FOREIGN PATENT DOCUMENTS

| | | | |
|---|---|---|---|
| 757154 | 10/1933 | France | 401/175 |
| 275525 | 10/1964 | Netherlands | 401/75 |
| 623535 | 6/1981 | Switzerland | 401/175 |
| 2150424 | 7/1985 | United Kingdom | 401/171 |

*Primary Examiner*—Steven A. Bratile

*Attorney, Agent, or Firm*—Wenderoth, Lind & Ponack

[57] ABSTRACT

A powder dispenser for supplying a predetermined amount of powder for, for example, cosmetic applicators, by a simple finger-tip operation. The dispenser has a tubular casing which has a nib at one end and an actuator at the other end thereof, a powder chamber containing therein a predetermined powder, a spiral member extending within the powder chamber, and a rotary device having an actuator for providing relative rotation between the spiral member and the powder chamber. A tube may be provided within the tubular casing to form the powder chamber.

2 Claims, 5 Drawing Sheets

POWDER DISPENSER

This application is a division, of now abandoned application Ser. No. 929,809, filed Nov. 13, 1986, now abandoned.

BACKGROUND OF THE INVENTION

The present invention relates in general to a dispenser for supplying powder contained in a chamber of the dispenser, and more particularly the present invention provides a dispenser for permitting a predetermined amount of powder to be supplied out of an outlet or nib of the dispenser by a simple manipulation of an actuator. The dispenser according to the present invention is applicable especially to, for example, cosmetics or cosmetic applicators such as rouge applicators, eye-shadow applicators, face-powder applicators and foundation applicators, paint applicators, flavoring material applicators, and other applicators which are generally used for dispensing a predetermined amount of powdery material by a simple manipulation of the actuator thereof.

Conventionally, many designs have been made to provide dispensers for supplying liquid such as writing ink and cosmetic liquid materials. The known dispensers for liquid have two types of structure, that is, a structure in which the liquid is forcibly fed to a nib by utilizing a piston or compressed air, and a structure in which the liquid is naturally fed by utilizing the capillary action of bellows or liquid feeding elements. However, the known dispensers are not applicable to powders.

SUMMARY OF THE INVENTION

An object of the present invention is to provide a new powder dispenser which can supply powder to a nib or point of the dispenser.

Another object of the present invention is to provide a powder dispenser which can be actuated by a simple manipulation.

A further object of the present invention is to provide a powder dispenser which permits a supply of a predetermined amount of powder to a nib or a point of the dispenser by a simple manipulation of an actuator of the dispenser.

Another object of the present invention is to provide a powder dispenser which provides relative rotation between a tubular housing for the powder and a spiral element positioned in the tubular housing so that a predetermined amount of powder is fed to a nib or point of the dispenser.

According to the present invention, there is provided a new powder dispenser comprising a substantially tubular casing, a nib connected to one end of the tubular casing, an actuator rotatably fitted to the other end of the tubular casing, a tube extending within the tubular casing for containing a powder and a spiral member extending longitudinally within the tube. In one embodiment of the invention, the tube is fixedly connected at its one end to the tubular casing and rotatably connected to the actuator, and the spiral member is connected at its one end to the actuator so that the spiral member is rotated within the tube by rotating the actuator by manipulation. In this embodiment, the tube for containing a powder can be omitted if the tubular casing functions as a housing of the powder. In another embodiment of the invention, the tube is rotatably connected at its one end to the tubular casing and fixed at its other end to the actuator. The spiral member is fixedly connected to the tubular casing. In this embodiment, the spiral member is immovable while the tube is rotatable by manipulation of the actuator.

DETAILED DESCRIPTION OF PREFERRED EMBODIMENTS

Preferred embodiments of the present invention will be described with reference to the drawings, wherein for clarification only, the powder dispenser in all embodiments is shown in the form of a writing instrument having a longitudinal tubular casing and a point or nib at one end thereof.

First Embodiment

Figure 1:
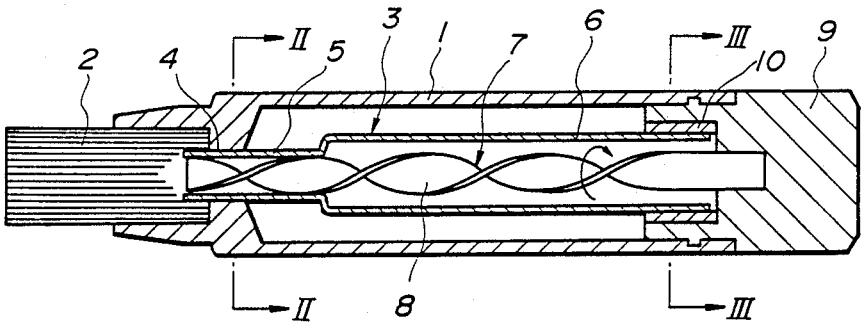
FIG. 1 is a longitudinal sectional view of a powder dispenser according to the first embodiment of the invention.
Figure 2:
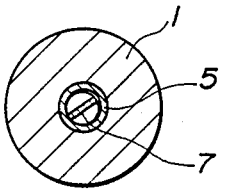
FIGS. 2 and 3 are sectional views of the powder dispenser taken along II—II and III—III, respectively, in FIG. 1.
Figure 3:
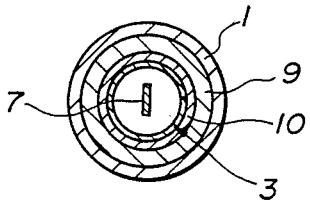

FIGS. 1 through 3 show the first embodiment of the invention, wherein reference numeral 1 represents a tubular casing which has at its front end a nib 2 which can hold powder for coating. The nib 2 in the illustrated embodiment is made of a bundle of natural or synthetic fibers, and it may be made of a porous resilient material such as sponge or synthetic rubber. A tube 3 which contains therein powder has a front portion 5 of reduced diameter which is fixed to a shoulder 4 of the tubular casing 1 so that a front opening of the tube 3 is connected to the nib 2. The tube 3 has a rear portion 6 of larger diameter and contains therein the powder. A spiral member 7 having a continuous, spirally inclined surface 8 is fixed at its rear end to an actuator 9 which is rotatably fitted to a rear end of the tubular casing 1, and is rotatably held at its front portion within the front portion 5 of reduced diameter. Thus, the spiral member 7 is rotated within the tube 3 by rotating the actuator 9 relative to the tube 3. The spiral member 7 in the embodiment of FIG. 1 can be easily formed by merely twisting a metal thin plate. A sealing ring 10 is disposed between the tube 3 and the actuator 9 to prevent the powder in the tube 3 being discharged out of a rear opening of the tube 3. The sealing ring 10 can be made of a suitable resilient material such as sponges and synthetic rubber so as to facilitate rotation of the actuator. The sealing ring 10 can be omitted if it is designed to have substantially no unnecessary space or gap between the rear end of the tube 3 and the actuator so that the powder is not discharged therethrough.

An operation of the powder dispenser shown in FIGS. 1 through 3 will be described. First, the dispenser is held so that the nib 2 is inclined downward and then the actuator 9 is rotated relative to the tubular casing 1 by a finger-tip operation to simultaneously rotate the spiral member 7. At this moment, the tube 3 also receives a rotational force through the sealing ring 10 but the tube 3 is not rotated since it is fixed at its front portion 5 of reduced diameter to the shoulder 4 of the tubular casing 1. The powder contained in the tube 3 is moved by gravity toward the front portion 5 of reduced diameter and delivered little by little into the front portion 5 of the tube 3 and further to the nib 2 by rotation of the inclined surface 8 of the spiral member 7. The amount of powder delivered to the nib 2 is controlled by the rotation of actuator 9.

The spiral member 7 of the first embodiment shown in FIG. 1 is suitable for the powder which has a low surface hardness and a tendency that particles of the powder adhere to each other. By contrast, if the powder has a high surface hardness and particles of the powder are unlikely to adhere to each other, the spiral member can be modified as described with reference to FIG. 4.

Figure 4:
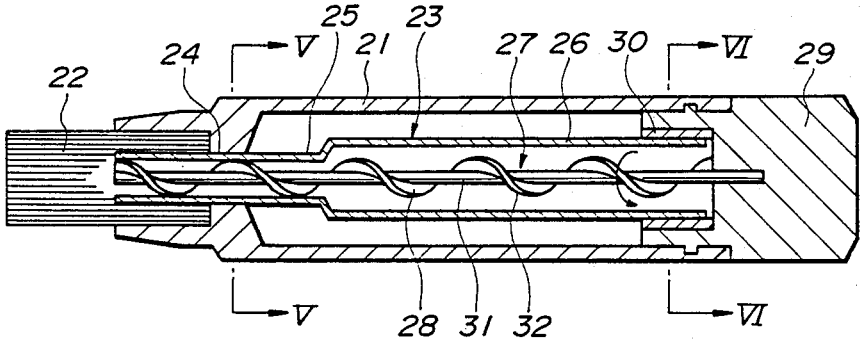
FIG. 4 is a longitudinal sectional view of a powder dispenser according to the second embodiment of the invention.
Figure 5:
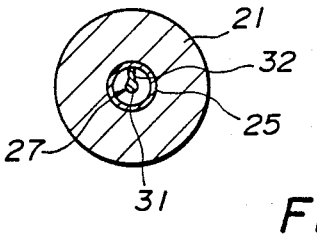
FIGS. 5 and 6 are sectional views taken along V—V and VI—VI, respectively, in FIG. 4.
Figure 6:
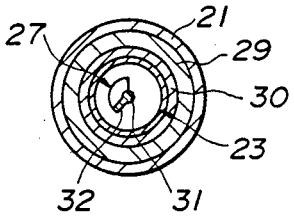
Figure 7:
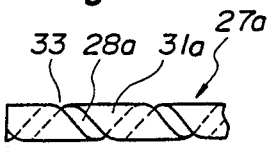
FIG. 7 shows modification of a spiral member.

FIGS. 4 through 6 show the second embodiment of the invention, that has a similar structure to that of the first embodiment of FIGS. 1 through 3 except for the modification of the spiral member. In the second embodiment, the spiral member 27 has a shaft 31 and a continuous, spiral vane spirally wound on the shaft 31 to form a spirally inclined surface 28. FIG. 7 shows a modified structure of the spiral member **27*a* which is formed by providing a spiral groove 33 on the surface of a rod 31*a* and a spirally inclined surface 28*a* by the groove 33. If the tube 3 is designed so that the front portion 25 of reduced diameter has larger frictional resistance to the powder than the spirally inclined surface 28, 28*a* of the spiral member by a surface treatment, abrasive treatment or selection of material having high frictional resistance, a delivery force of the powder can be increased to provide reliable delivery of the powder to the nib 22**.

In the first and second embodiments described above, the spirally inclined surfaces 8, 28, **28*a* are illustrated to extend for a substantial length of the tubes 3, 23 but may be designed so that they extend along only the length of the front portions 5, 25 of reduced diameter. Besides, the front portions 5, 25 of the tubes 3, 23 can be formed as short as possible. In the first and second embodiments, the tubular casings 1, 21 can function as the tubes 3, 23 and thus the tubes 3, 23 can be omitted if desired and if mechanical strength can be somewhat sacrificed. Although relative rotary movement between the spiral members 7, 27 and the tubes 3, 23** is achieved by rotation of the spiral members while the tubes are held fixed in the first and second embodiments, the relative rotary movement can be achieved by rotating the tube while the spiral member is held fixed, as described hereinbelow.

A Third Embodiment

Figure 8:
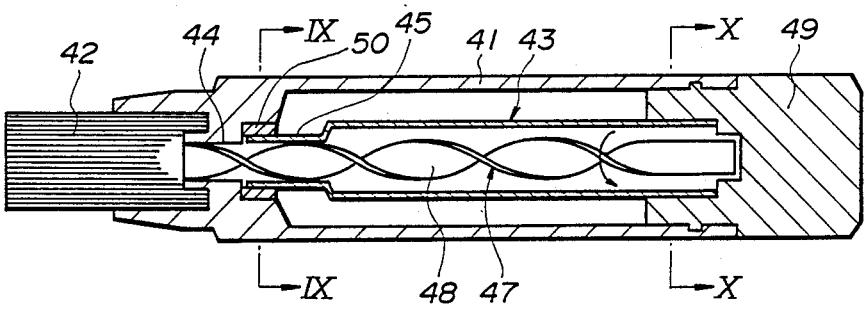
FIG. 8 is a longitudinal sectional view of a powder dispenser according to the third embodiment of the invention.
Figure 9:
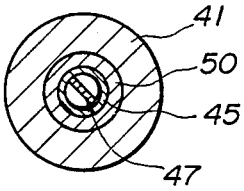
FIGS. 9 and 10 are sectional views taken along IX—IX and X—X, respectively, in FIG. 8.
Figure 10:
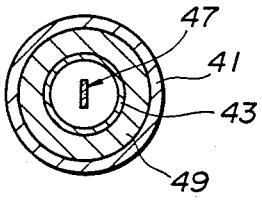

FIGS. 8 through 10 show the third embodiment of the invention. A nib is held at the front end of a tubular casing 41 and an actuator 49 is rotatably fitted to a rear end of the tubular casing. In the embodiment of FIGS. 8–10, a tube 43 for containing therein the powder is fixedly connected at its rear end to the actuator, and rotatably mounted at its front portion 45 on the inner wall of the tubular casing 41 through a sealing ring 50. The tube 43 is rotated within the tubular casing 41 by rotating the actuator 49. The sealing ring 50 is preferably made of a resilient material and prevents powder from escaping out of a front opening of the tube 43. The sealing ring 50 can be omitted if it is designed so that the front portion 45 of reduced diameter of the tube 43 is desirably rotatably fitted to the inner wall of the tubular casing 41 without any undersirable gap therebetween through which powder escapes. A spiral member 47 which has a continuous, spirally inclined surface 48 is fixed to a bore wall 44 of the tubular casing 41.

An operation of the powder dispenser according to the third embodiment will be described. First, the dispenser is held slightly inclined so that powder in the tube is moved towards the nib 42 by gravity and then the actuator 49 is rotated by a finger-tip operation. Thus, rotation of the actuator 49 rotates the tube 43. The powder in the tube 43 has been moved by gravity to the front portion 45 of reduced diameter of the tube 43 and is rotated along with rotation of the tube 43. The powder is then delivered little by little to the front portion 45 and then to the nib 43 by the spirally inclined surface 48 of the spiral member 47. The amount of powder supplied to the nib 42 depends substantially on the number of rotations of the tube 43 and, accordingly, a desired amount of powder can be supplied to the nib by controlling rotation of the actuator 49.

Fourth Embodiment

Figure 11:
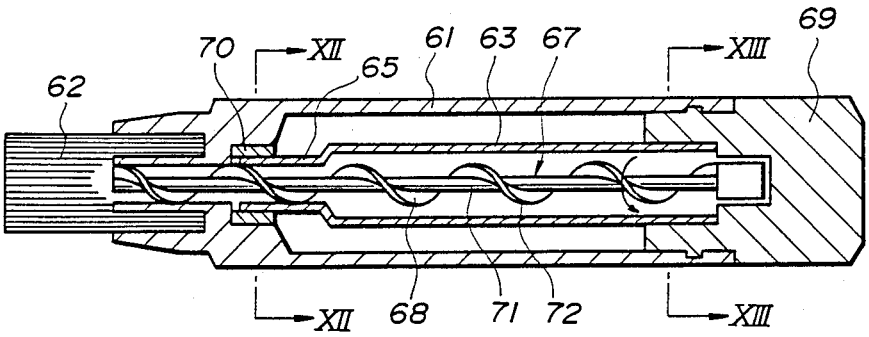
FIG. 11 is a longitudinal sectional view of a powder dispenser according to the fourth embodiment of the invention.
Figure 12:
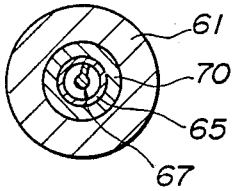
FIGS. 12 and 13 are sectional views taken along XII—XII and XIII—XIII, respectively, in FIG. 11.
Figure 13:
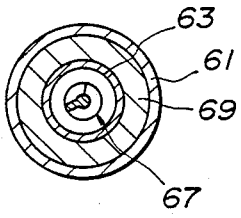

FIGS. 11 through 13 show the fourth embodiment of the invention. This embodiment shows a combination of the second embodiment and the third embodiment, in which a spiral member 67 which is similar to the spiral member 27 of the second embodiment (FIG. 4) is applied to the tubular casing assembly of the third embodiment (FIG. 8).

As will be apparent from the foregoing description, the powder dispenser according to the present invention provides a relative rotation between the tube which contains the powder and the spiral member which has a spirally inclined surface. By a relative rotation of the two elements, a desirable amount of powder is supplied to the nib of the dispenser.

Fifth Embodiment

Figure 14:
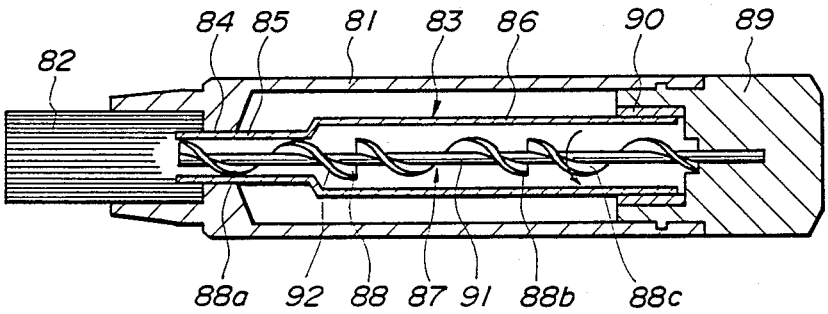
FIG. 14 is a longitudinal sectional view of a powder dispenser according to the fifth embodiment of the invention.
Figure 15:
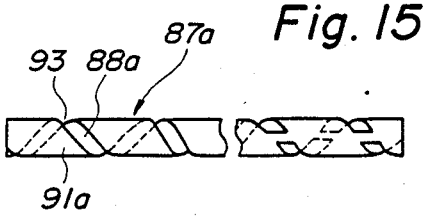
FIGS. 15 and 16 show modifications of a spiral member employed in the embodiment of FIG. 14.
Figure 16:
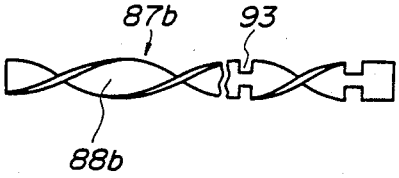

FIG. 14 shows the fifth embodiment of the invention, in which a modified spiral member 87 is employed for successfully grinding and agitating the powder in the form of bulk or mass if the powder is formed into lumps. In FIG. 14, a spiral member 87 has a rod 91 and a spiral vane 92 on the rod 91 to have a spirally inclined surface 88. In the embodiment of FIG. 14, the spiral vane is divided into three sections 88*a*, 88*b* and 88*c*. The spiral vane section 88*a* is continuously extended along a substantial length of, and within, the front portion 85 of reduced diameter and the other part of the vane 92 in the rear portion 86 of the tube 83 such as vane sections 88*b*, 88*c* is discontinued at a predetermined interval with their phase being offset as illustrated. In the illustrated embodiment, the spirally inclined surface 88 is formed by the spiral vane 92, but similar, spirally inclined surface can be formed by providing a spiral groove 93 on the surface of a rod 91*a* so that a spiral member 87*a* is formed, as illustrated in FIG. 15. Alternatively, a metal thin plate is twisted to form a spiral member 87*b* to provide a spirally inclined surface 88*b*. In order to provide a discontinued spirally inclined surface along the length of the rear, large diameter portion 86 of the tube 83, a plurality of discontinued grooves can be formed in the structure of FIG. 15, and alternatively, slits 93 can be formed on the twisted plate at a desired interval in the structure of FIG. 16.

An operation of the powder dispenser in the fifth embodiment (FIG. 14) is substantially similar to that of the previous embodiments, particularly the first embodiment (FIG. 1) and the second embodiment (FIG. 4). When an actuator 89 is rotated relative to a tubular casing 81, the spiral member 87 fixed to the actuator 89 is rotated within the tube 83. At this moment, the tube 83 which contains the powder receives a rotational force of the actuator 89 through a sealing ring 90, but the tube 83 is not rotated at all since same is fixed to the inner wall 84 of the tubular casing 81. When the dispenser is inclined, powder in the tube 83 is moved by gravity in the tube 83 toward the nib 82 and then delivered little by little into the front portion 85 of reduced diameter of the tube 83 and finally to the nib 82. The amount of powder delivered to the nib depends substantially upon the number of rotation of the actuator 89, and a desired amount of powder can be delivered to the nib by controlling rotation of the actuator 89. In the embodiment of FIG. 14, the discontinued, spirally inclined surface 88*b*, 88*c* positioned within the rear portion 86 is simultaneously rotated to grind and agitate bulk powder even if the powder is formed into lumps. Namely, the discontinued, spirally inclined surface 88*b* functions to grind and agitate the powder rather than to deliver the powder toward the front portion 85. Therefore, a reliable delivery of powder to the nib 82 can be obtained even if the powder is formed into lumps over time. Although the vane sections 88*b*, 88*c* located in the rear portion 86 of the tube 83 is shown to have a diameter substantially equal to that of the vane section 88*a*, the vane sections 88*b*, 88*c* can be designed to have a larger diameter which is slightly smaller than an inner diameter of the rear portion 86 of the tube 83. The tube 83 may have any other shape such as a conical shape which tapers toward the nib 82.

Sixth Embodiment

Figure 17:
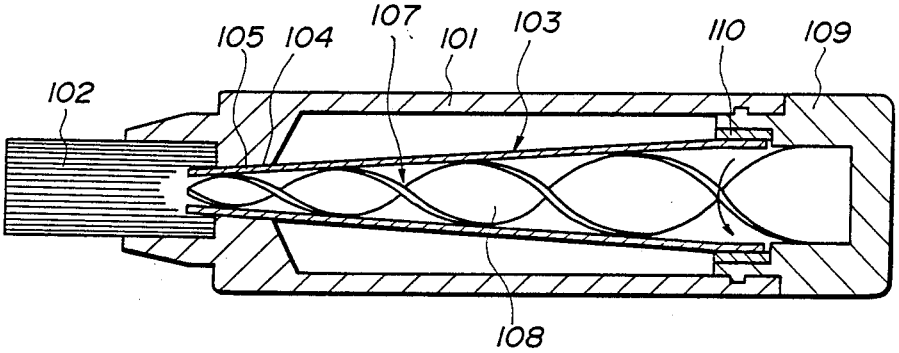
FIG. 17 is a longitudinal sectional view of a powder dispenser according to the sixth embodiment of the invention.

FIG. 17 shows the sixth embodiment of the invention in which powder can be reliably supplied to the nib even if the dispenser is held inclined so that the nib faces upward. A nib 102 is mounted on one end of a tubular casing 101 and an actuator 109 is rotatably fitted to the other end of the tubular casing 101. A tube 103 of a conical shape is fixedly connected at its front end portion to an inner wall 104 of the tubular casing 101 and held at its rear end indirectly to the casing 101 through a sealing ring 110 and a flange of the actuator 109. A spiral member 107 having a spirally inclined surface 108 is rotatably positioned within the conical tube 103, and connected at its rear end to the actuator 109. As illustrated, the spiral member 107 is shaped so that the radially inclined surface has a width which becomes larger towards the actuator 109 in accordance with an increase of diameter of the tube 103. The spiral member 107, which is shaped in accordance with the shape of the tube 103, can be easily formed by twisting a thin plate of metal or any other suitable material having a width which becomes larger as it extends from one end to the other. The sealing ring 110 which is preferably made of a resilient material such as synthetic rubber and sponge functions to prevent powder in the tube 103 from escaping out of an opening of the tube 103 and to facilitate rotation of the actuator 109. The tube 103 can be shaped into any other desired form, not illustrated.

In operation, the actuator 109 is rotated by manipulation relative to the tubular casing 101 to thereby rotate the spiral member 107. At this moment, the powder containing tube 103 which receives a rotational force of the actuator 109 is not rotated but held still since it is fixedly connected at its front portion 105 to an inner wall 104 of the tubular casing 101. By rotation of the spiral member 107 within the taper-shaped tube 103, the powder located in a rear, a larger diameter portion of the tube 103 is gradually moved toward the front, reduced diameter portion 105 and then powder is suitably delivered to the nib 102 by rotation of the spirally inclined surface 108 within the front, reduced diameter portion. The amount of powder which is delivered to the nib is controlled by adjustment of rotation of the actuator 109. Thus, powder located at the rear portion of the tube 103 can be successfully delivered toward the front portion of the tube even when the dispenser is held front-side up or inclined so that the nib 102 faces upward and the actuator faces downward.

Seventh Embodiment

Figure 18:
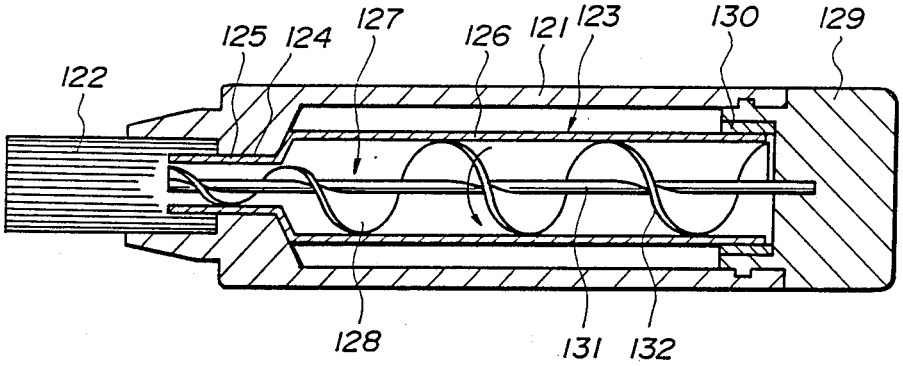
FIG. 18 is a longitudinal sectional view of a powder dispenser according to the seventh embodiment of the invention.

FIG. 18 shows the seventh embodiment of the invention, which shows a similar structure as the sixth embodiment of FIG. 17 except for modification of powder delivery mechanism. In FIG. 18, a tubular casing 121 has a nib 122 at one end and a rotatable actuator 129 at the other end as similar as the structure of FIG. 17, and a tube 123 for containing therein the powder has a front portion 125 of reduced diameter and a rear portion 126 having a larger diameter as similar as the previous embodiment of FIGS. 1 through 14. The front portion 125 is fixedly connected to an inner wall 124 of the tubular casing and projects into the nib 122. The rear portion 126 of the tube 123 is held at its rear end by a sealing ring 130 which is fixed inside the flange of the actuator 129. A spiral member 127 having a continuous, spirally inclined surface 128 is rotatably positioned in the tube 123. In the illustrated embodiment, the spiral member 127 has a shaft 131 and a spiral vane 132 on the shaft 131 to form the continuous, spirally inclined surface 128. The spiral vane 132 has a smaller diameter at the front portion 125 of the tube 123 and a larger diameter at the rear portion 126. Thus, powder located at the rear end portion of the tube 123 can be successfully delivered toward the front, reduced diameter portion 125 even when the dispenser is held front-side up or inclined so that the nib 102 faces upward and the actuator faces downward.

Although the embodiments of FIGS. 17 and 18 show rotation of the spiral member 107, 127 while the tube 103, 123 is fixed, a modification may be made so that the tube (103, 123) can be rotated while the spiral member (107, 127) is fixed, as similar as the embodiments of FIGS. 3 and 4.

Eighth Embodiment

Figure 19:
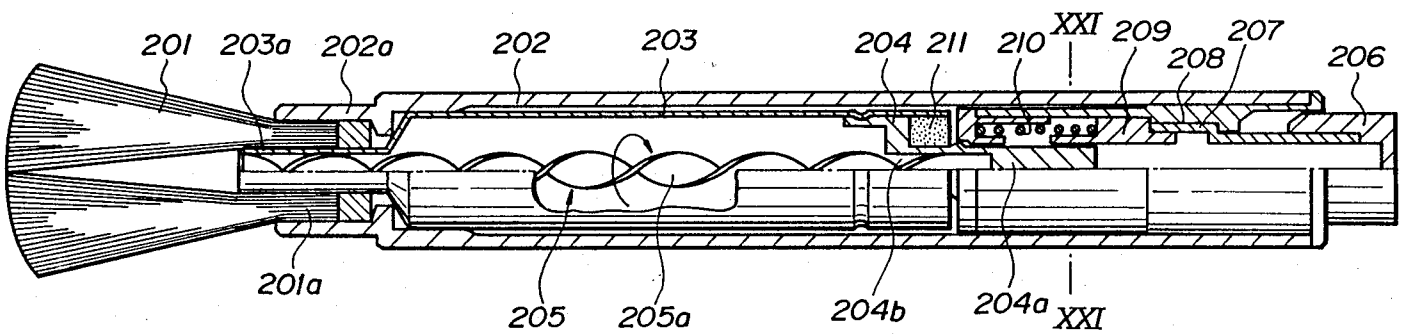
FIG. 19 is a longitudinal sectional view of a powder dispenser according to the eighth embodiment of the invention.
Figure 21:
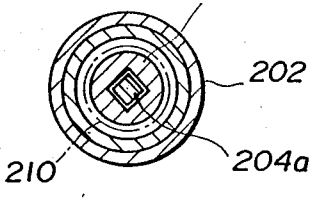
FIG. 21 is a sectional view taken along XXI—XXI in FIG. 19.
Figure 20B:
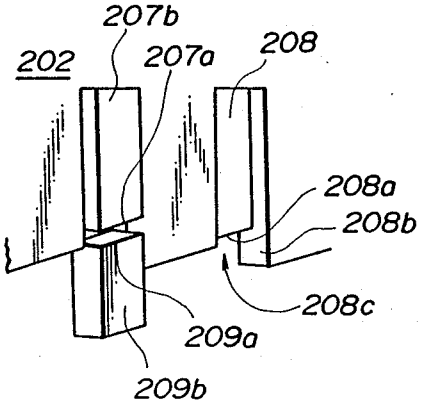
FIGS. 20A and 20B are illustrations of a rotary mechanism employed in the powder dispenser shown in FIG. 19.
Figure 20A:
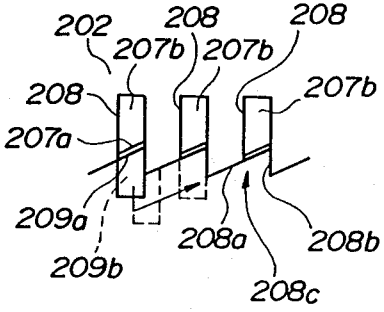

FIGS. 19 through 21 show a further modification of the powder dispenser. A nib 201 which is capable of containing and coating a desired powder is fixed at its base portion 201*a* to a front end 202*a* of a tubular casing 202. The nib 201 may be as similar as the nibs of the previous embodiments and preferably be made of natural or synthetic fibers or any other suitable materials such as sponge and synthetic rubber. A tube 203 which contains therein the predetermined powder for use is fixedly positioned in a tubular casing 202, and a front opening portion 203*a* is inserted into the base portion 201*a* of the nib 201. Reference numeral 204 is a rotary element in the form of a cylindrical shape having an engaging portion 204*a* which unrotatably and slidably engages with a cylindrical rotary body 209. A spiral member 205 which is formed by simply twisting a metal thin plate is rotatably fitted in the front opening portion 203*a* of the tube 203 at the front end portion thereof, and the rear end of the spiral member 205 is press-fitted to a recess 204*b* of the rotary element 204 so that when the rotary element 204 is rotated the spiral member 205 is simultaneously rotated within the tube 203. An actuator or push button 206 projecting from a rear end of the tubular casing 202 has a predetermined number of projections 207*b* each having an inclined surface 207*a* on its front end. The projections 207*b* are formed on a circumferential outer surface thereof. The number of projections 207*b* is identical to the number of grooves 208 which are formed on a rear inner surface of the tubular casing at a predetermined interval. The actuator 206 has a slider 207 which projects forward to forcibly insert the projections 207*b* into the grooves 208 on the rear inner surface of the tubular casing 202. The rotary body 209 is rotatably positioned adjacent to the slider 207 and has a plurality of projections 209*b* each having at its rear end an inclined surface 209*a* which inclines in the same direction as the inclination of the inclined surface 207*a*. The rotary body 209 is spring-biased in the rearward direction by a spring 210. The spring 210 urges the projection 209*b* into a recess 208*c* which is formed by a combination of an inclined surface 208*a*, which inclines in the same direction as the inclined surface 209*a*, and a vertical surface 208*b*. The rotary body 209 has a rectangular bore for slidably but unrotatably receiving the engaging portion 204*a* of the rotary element 204 as illustrated in FIG. 21. In FIG. 19, reference numeral 211 represents a sealing ring which is fitted to the rear end of the tube 203 for preventing powder in the tube 203 from escaping from a rear opening of the tube 203.

An operation of the powder dispenser shown in FIGS. 19 through 21 will be explained. When the actuator 206 which projects from the rear end of the tubular casing 201 is pushed into the casing by a finger-tip operation, the projections 207*b* of the slider 207 move along the grooves 208 so that the inclined surface 207*a* of the slider 207 contacts the inclined surface 209*a* of the projection 209*b* of the rotary body 209. Thereafter, the projection 209*b* is pushed forward to advance the rotary body 209. The rotary body 209 is spring-biased in the rearward direction and the inclined surface 209*a* is pushed by the inclined surface 207*a* of the projection 207*b* of the slider 207. Thus, the projection 209*b* is rotated a little after it passes over a front end of the vertical surface 208*b* of the recess 208*c* and then placed into the inclined surface 208*a* of the next recess 208*c*. When the pressure added to the actuator is released, the projection 209*b* is rotated along the inclined surface 208*a* until it abuts against the vertical surface 208*b*. In the embodiment of FIGS. 19 through 21, the rotary body can be rotated in accordance with the pitch of the grooves 208*c* of the tubular casing 202 by actuation of the actuator 206. Therefore, the rotary element 204 is rotated relative to the tube 203 through the engagement portion 204*a* which is slidably but unrotatably engaged with the rotary body 209. Thus, powder in the tube 203 is gradually delivered toward the nib 201 by the effect of a spirally inclined surface 205*a* of the spiral member 205 which is rotated together with the rotary element 204.

The rotary mechanism employed in the embodiment of FIGS. 19 through 21 is useful and can be applied to the various embodiments shown in FIGS. 1 through 18, and a predetermined, suitable amount of powder can be supplied to the nib by a simple manipulation of the actuator.

Although the present invention has been described with reference to the preferred embodiments, many modifications and alterations can be made within the spirit of the invention.

What is claimed is:

1. A powder dispenser for supplying a predetermined amount of powder comprising:

a tubular casing having opposite ends;

a powder chamber for containing a powder disposed within said tubular casing, said powder chamber having opposite ends;

a nib attached at one end of said tubular casing and said powder chamber, said nib having means for holding a powder, and said nib communicating with said powder chamber;

an actuator slidably attached to the other end of said tubular casing for actuating a rotary actuator means;

a rotary actuator means for rotating a spiral member relative to said powder chamber, and attached to said tubular casing, said rotary actuator means including a rotary body and a rotary element, said rotary element being slidably and unrotatably engaged with said rotary body for rotary movement thereby;

a spiral movement attached to said rotary element for rotation therewith and extending within said powder chamber for contacting and moving the powder in said powder chamber;

advancing means in said tubular casing for incrementally rotatably advancing said rotary body for incrementally rotating said rotary element for incrementally rotating said spiral member for incrementally moving a predetermined amount of powder within said chamber toward said nib, and said rotary actuator means actuating said advancing means; and said actuator actuating said rotary actuator means for actuating said advancing means for incrementally rotatably advancing said rotary body for moving said rotary element for rotating said spiral member relative to said powder chamber for moving the powder within said chamber toward said nib for being delivered thereto.

2. A device as in claim 1, wherein said spiral member is sufficiently large for extending substantially the length and width of said powder chamber for contacting and moving the powder in substantially all areas of said powder chamber.

* * * * *